US006289551B1

(12) United States Patent
Basile

(10) Patent No.: US 6,289,551 B1
(45) Date of Patent: Sep. 18, 2001

(54) STEAM CLEANING APPARATUS

(75) Inventor: Salvatore Basile, Padua (IT)

(73) Assignee: Simac-Vetrella SpA, Cazzago di Pianiga (IT)

( * ) Notice: Subject to any disclaimer, the term of this patent is extended or adjusted under 35 U.S.C. 154(b) by 0 days.

(21) Appl. No.: 09/355,107

(22) PCT Filed: Nov. 24, 1998

(86) PCT No.: PCT/IB98/01863

§ 371 Date: Jul. 23, 1999

§ 102(e) Date: Jul. 23, 1999

(87) PCT Pub. No.: WO99/26522

PCT Pub. Date: Jun. 3, 1999

(30) Foreign Application Priority Data

Nov. 26, 1997 (IT) ..... UD97A0219

(51) Int. Cl.[7] ..... A47L 11/03
(52) U.S. Cl. ..... 15/320; 15/393
(58) Field of Search ..... 15/320, 319

(56) References Cited

U.S. PATENT DOCUMENTS 1,803,693 * 5/1931 Cutting ..... 15/320
3,061,959 * 11/1962 Blumenfeld ..... 15/320 X
4,583,260 * 4/1986 Zai ..... 15/320 X
4,696,074 * 9/1987 Cavalli ..... 15/321
5,386,612 * 2/1995 Sham ..... 15/320
5,502,872 * 4/1996 Chae et al. ..... 15/320
5,920,952 * 7/1999 Baldacci ..... 15/320
6,031,969 * 2/2000 Burr et al. ..... 15/320 X

* cited by examiner

*Primary Examiner*—Chris K. Moore
(74) *Attorney, Agent, or Firm*—Antonelli, Terry, Stout & Kraus, LLP

(57) ABSTRACT

Steam cleaning apparatus for plane surfaces, comprising a closed case containing structure (11) with a lower face (11*b*) substantially flat suitable to cooperate with the plane surface to be cleaned and an upper face (11*a*) suitable to cooperate with movement and command controls (12), the containing structure (11) including inside itself structure (18) to generate steam under pressure comprising a pump (19) and an instantaneous generator (20) equipped with a rapid heater (21), the containing structure (11) cooperating with a tank (22) containing water at room temperature, the lower face (11*b*) of the containing structure (11) including steam delivery holes, the delivery holes (30) defining on the lower face (11*b*) of the containing structure (11) at least two distinct delivery zones, respectively forward and central, which can be selected by the user by means of a selector (32), the tank (22) containing water being able to be temporally removed from the containing structure (11) so that refilling operations can be carried out.

11 Claims, 2 Drawing Sheets

STEAM CLEANING APPARATUS

FIELD OF THE INVENTION

This invention concerns a steam cleaning apparatus.

The cleaning apparatus according to the invention is limited in bulk, light, manageable, easily transportable and can be used to clean both floors and vertical surfaces, whether they be extensive, limited in size and/or difficult to access.

BACKGROUND OF THE INVENTION

The state of the art includes steam cleaning apparatus including a steam production unit consisting essentially of a boiler housed in an autonomous containing structure, usually equipped at the lower part with wheels or suchlike, equipped with a flexible tube to which a desired cleaning accessory can be optionally associated.

These containing structures are usually very large and very heavy, in proportion to the size of the boiler, so that the apparatus is sufficiently autonomous for the required cleaning operations.

This makes the apparatus less practical to use, more difficult to transport and less manageable.

It is well-known, for example, that users find considerable difficulty in cleaning extensive or vertical surfaces, since such operations involve dragging or lifting the containing structure from one place to another.

Moreover, when they are not in use such appliances require ample storage space. Furthermore, appliances of this type use a great deal of energy because they have to keep a large quantity of water at evaporation temperature.

Moreover, they are very dangerous to use because the boiler has to be maintained under pressure.

Furthermore, in apparatus known to the art the steam generated by the boiler is delivered to the cleaning accessories through corrugated pipes, or similar, of great length; this causes the steam to lose pressure and therefore the efficiency of the cleaning action is lessened.

Moreover, with such apparatus it is possible to regulate the outlet pressure of the steam, but it is not possible, when using the same accessory, to differentiate the cleaning action to adapt it to the type and/or size or conformation of the surface which is to be cleaned or the degree of cleaning required.

Another problem of such appliances as are known to the art is that a great deal of time is wasted every time the boiler has to be refilled; this is because, before refilling, the user must wait until the pressure inside the boiler has dispersed and then, after refilling, the user must again wait until the water is transformed into steam.

The refilling action itself is moreover not very practical in that it usually requires the use of funnels or appropriate recipients to transport the water from the delivery area to where the cleaning apparatus is being-used.

Another problem is that, when the apparatus is connected with cleaning cloths or rags, it is necessary to use predetermined elements, which cannot be exchanged with other, more common ones, and this causes an increase in costs.

In order to solve, at least in part, the afore-mentioned problems, there have been proposals for compact cleaning devices equipped with incorporated means to produce steam.

DE-A-3031263, for example, describes a cleaning apparatus, used in particular to clean carpets or suchlike, including a closed containing structure sub-divided into two super-imposed chambers communicating with each other by means of an adjustable valve.

The upper chamber functions as a reservoir for the cold water and the lower chamber is used to produce steam.

For this purpose, the lower chamber is equipped with a heated plate equipped with a plurality of through holes associated with respective steam delivery holes on the lower face, that is to say, the face in contact with the surface to be cleaned, of the containing structure.

The water contained in the upper chamber passes through the valve into the second chamber and, as it comes into contact with the heated plate, is transformed into steam which comes out through the delivery holes.

This cleaning apparatus has the disadvantage that the valve which regulates the flow of water to the heated plate is difficult to set.

Moreover, this method of forming steam using a heated plate does not guarantee that all the water introduced into the second chamber can be changed into steam, with a consequent leakage of water from the delivery holes and therefore an excessive dampening of the surface to be cleaned.

In addition, the heated plate is quickly covered with scale, and thus loses its heating power and drastically reduces its steam producing capacity.

This cleaning apparatus, moreover, is not suitable for cleaning limited surfaces or corners or areas. which are difficult to get at, since the steam delivery holes are concentrated in the central part of the lower face.

The European patent EP-A-0,253,910 describes a steam cleaning apparatus comprising a longitudinal body defining inside itself a tank to contain water associated by means of a pump which can be selectively activated with a boiler suitable to generate instant steam and arranged substantially in correspondence with the foot of the apparatus.

The outlet of the instantaneous boiler is associated with a steam delivery nozzle with which cleaning accessories such as brushes, nozzles or otherwise can be associated when so desired.

This apparatus is not at all practical, difficult to use and manoeuvre because of the size of the handle and the weight of the water tank, which is arranged on the handle itself and has to be supported by the user during the cleaning operations.

IT-B-1194529 teaches to provide a washing apparatus of the type as in DE-A-3031263, but with a tank applied on the handle.

According to a variant there is an auxiliary tank which is located adjacent to the mini-boiler in such a manner as to be pre-heated thereby.

This document teaches to obtain a washing apparatus which is complex in structure and in operation due to the inclusion of two different tanks which can be applied on different occasions when desired.

This creates problems for the user, and also problems of water tightness and duration of the tank in contact with the mini-boiler.

With this solution it also takes a long time for the water to be brought to evaporation.

EP-A-0,842,631 describes a steam cleaning apparatus equipped with a handle connected at the end to a closed containing structure whose lower face is suitable to be rested on the surface to be cleaned.

The closed containing structure houses an inseparable boiler which produces steam at atmospheric pressure by means of electric resistors.

The closed containing structure is equipped at the upper part with a filling aperture communicating with the boiler and its dome-shaped top cooperates with the upper end of a conduit whose lower end is associated with a collector provided with a plurality of steam delivery holes arranged in a single line.

This arrangement of the delivery holes gives an effective cleaning action on extensive surfaces but it is not very suitable for cleaning edges, corners or more generally limited surfaces or surfaces with restricted access.

Moreover, in this device it is not possible to vary the manner in which the steam is delivered so as to give different levels of cleaning and/or to adapt the impact and geometry of the steam delivery to the type of surface to be cleaned.

This cleaning device, moreover, has the disadvantage-that, in order to fill it, it requires a funnel and a measuring device, which entails inconvenience and frequent interruptions for the user, especially considering the limited capacity of the boiler.

Another disadvantage is the time wasted while waiting for the electric resistors to transform the water contained in the boiler into steam.

Furthermore, the device has outer parts which over-heat during use, such as the cap on the tank and the edge of the boiler, which can scald the user during refilling operations.

Moreover, this device needs to be disconnected from the electricity supply while refilling is carried out, in order to avoid the danger of electrocution.

This is an intrinsic danger of all devices described in the prior art documents cited above.

Another disadvantage is that the device requires special cloths to be used which must therefore be kept constantly to hand and replaced, after use, in places where they can easily be found.

The present applicant has designed and embodied this invention to overcome the shortcomings of the state of the art and to provide further advantages.

SUMMARY OF THE INVENTION

The purpose of the invention is to provide a steam cleaning apparatus, mainly for domestic use, suitable to generate pressurised steam instantaneously.

Another purpose of the invention is to provide a steam cleaning apparatus which is both simple in its construction and in its functioning, of limited bulk, light, transportable, manageable, safe, reliable and using very little energy.

A further purpose of the invention is to provide a cleaning apparatus which will allow the user to vary the methods of delivering steam so as to give different degrees of cleaning and/or to adapt the force and shape of the jet of steam according to the surface to be cleaned.

Another purpose is to simplify and accelerate the refilling operations, at the same time avoiding risks of scalding and electrocution for the user.

A further purpose is to supply a cleaning device which allows cleaning cloths of any type whatsoever to be associated.

The apparatus according to the invention consists in its essential parts of a containing structure with a closed case, with a flat lower face so as to connect with the surface to be cleaned, of extremely limited bulk and associated at the upper part with the handle.

In the preferential embodiment the handle is associated with the containing structure by means of articulated joints which make the cleaning apparatus more manageable and easier to move.

On the lower face of the containing structure there are steam delivery holes and sliding means by which the apparatus slides over the surface to be cleaned, such as runners, rollers, brushes or similar.

According to a variant, the sliding means are at least partly retractable, or can be excluded so that cleaning cloths or rags or similar can be associated with the lower face of the containing structure which will collect the dirt removed by the steam.

According to the invention, there are rapid gripping means on the lower face or at the sides thereof so that it is possible to attach to or detach from the lower face rags or cloths of any type whatsoever, provided that they are of the appropriate size, in a simple and speedy manner.

According to the invention, the containing structure houses the instant steam generation unit, which comprises pump means to deliver the cold water, contained in a tank, to an instant generator-of pressurised steam.

According to a variant, the whole steam generation unit, comprising the pump means and the instant generator, can be removed from the containing structure in order to facilitate maintenance operations, or even to allow the steam generation unit to be associated with other domestic appliances such as, for example, irons, humidifiers, spray-gun cleaning accessories, etc.

According to a variant, only the tank may be temporally removed from the containing structure, so that it may be refilled or emptied; the refilling or emptying operations can easily be achieved, without requiring the use of accessories such as funnels or similar and without any risk of burns.

According to another variant, the tank incorporates, or cooperates with, demineralising filters which prevent the formation of calcium deposits in the steam generation unit.

According to the invention, the instant generator includes rapid heating means to heat the cold water fed by the pump and at least an outlet aperture for the steam associated with the aforesaid steam delivery holes by means of delivery conduits or similar.

According to the invention, the steam delivery holes define, on the lower face of the cleaning apparatus, several distinct zones from which the steam emerges. The steam outlet zones can be activated/de-activated individually by the user according to the type or degree of cleaning required and/or according to the accessibility of the surface to be cleaned.

According to a variant, it is possible to deliver steam simultaneously from more than one steam outlet zone.

According to the invention, the outlet of steam from one and/or another-outlet zone is regulated by means of manually or electrically adjustable interception means.

According to a variant, the aforesaid handle also functions as a means to switch on/off the steam generation unit.

According to a variant, the handle can assume at least a vertical position which switches on the steam generating unit, and at least a lowered position which activates the pump means to deliver the steam to the exterior.

According to another variant, the pump means and/or the steam generating unit are activated by the user by means of drive means to be found on the handle.

According to a further variant, at least the pump means are activated automatically by an electronic drive and control unit.

According to another variant, the pump is activated temporally with a frequency which can be selected by the user.

According to a variant, in cooperation with the steam outlet of the steam generating unit there are pressure switch means governing the instantaneous heating means; when the pump is reactivated, the pressure switch means cause the instantaneous heating means to be activated and conditioned as they function in such a way as to obtain steam immediately, thus ensuring continuous functioning.

In the preferential embodiment of the invention, the electronic drive and control unit governs desired monitoring means, signalling means, safety means, etc.

BRIEF DESCRIPTION OF THE DRAWINGS

The attached Figures are given as a non-restrictive example, and show a preferred embodiment of the invention as follows.

FIG.

FIG.

DETAILED DESCRIPTION OF THE PREFERRED EMBODIMENT

Figures 1, 3:
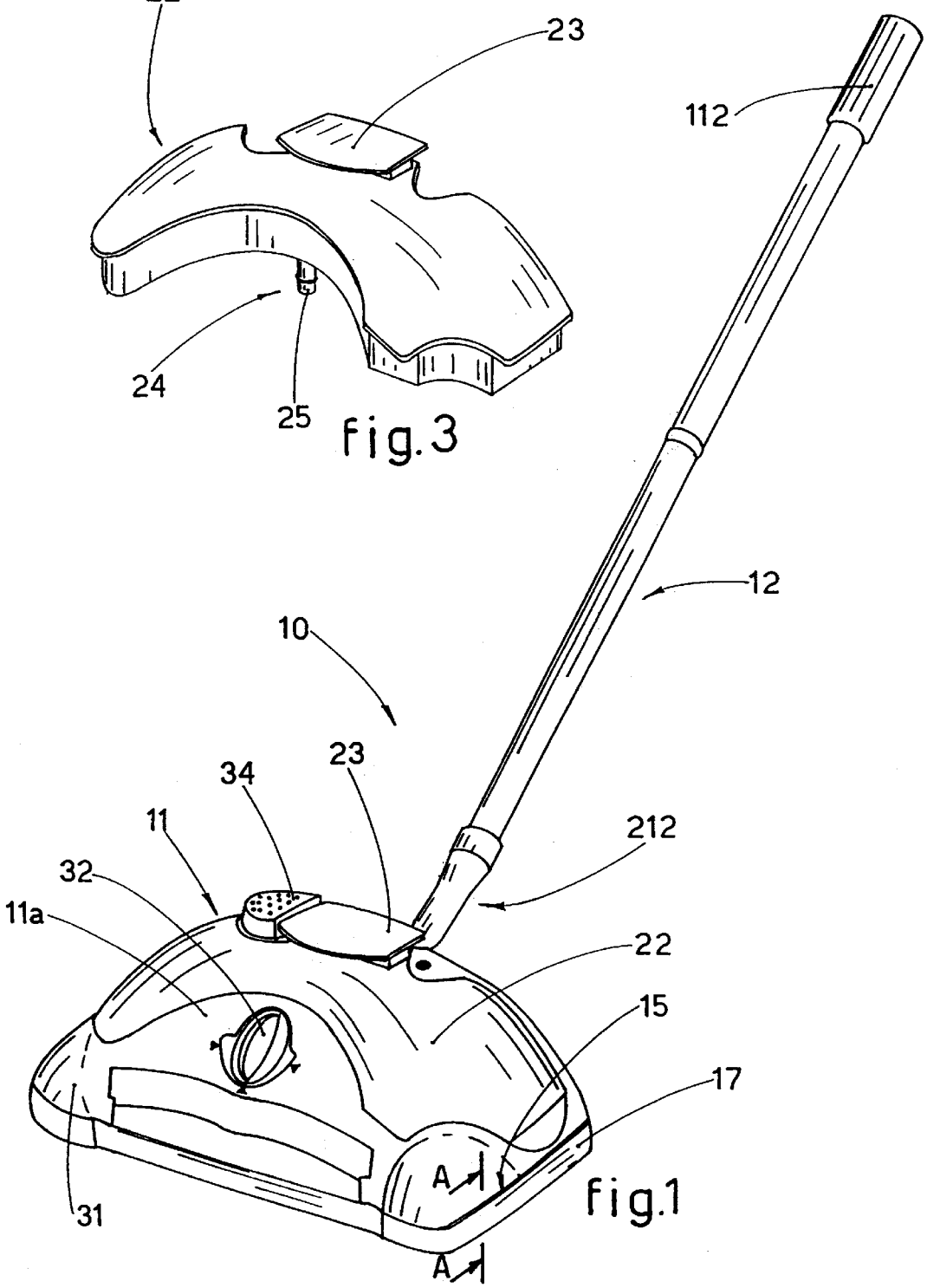
FIG. 1 shows a three-dimensional view of a steam cleaning apparatus according to the invention.
FIG. 3 shows a three-dimensional view of the water tank of the apparatus shown in FIG. 1.

The steam cleaning apparatus 10 shown in the attached figures has a containing structure 11, in this case with an upper face 11*a* shaped substantially like a cap, associated at the upper part with a handle 12, in this case of the telescopic type and/or detachable, equipped with a grip 112 for the user.

The apparatus 10 has a lower face 11*b* which is substantially flat so as to connect with the surface to be cleaned, whether it be a floor, a wall, a window, etc.

On the lower face 11*b* there are sliding means 13, in this case wheels 14, to move the apparatus 10 over the surface to be cleaned. The wheels 14 can be retracted, thus allowing the user to associate with the lower face 11*b* of the containing structure 11 cleaning cloths or rags 16 of any common type, in order to remove from the surfaces to be cleaned the dirt removed by the steam.

In the embodiment shown here, on the short sides of the containing structure 11 there are gripping means 15 consisting of elastic fins 17 facing upwards and including a tooth 117 facing inwards so as to grip the end of the cleaning cloth 16, which has been folded back.

The elastic fins 17 define a containing seating 217 underneath the tooth 117 wherein the end of the cloth 16 may be wound upon itself so as to create a stable grip.

Figure 2:
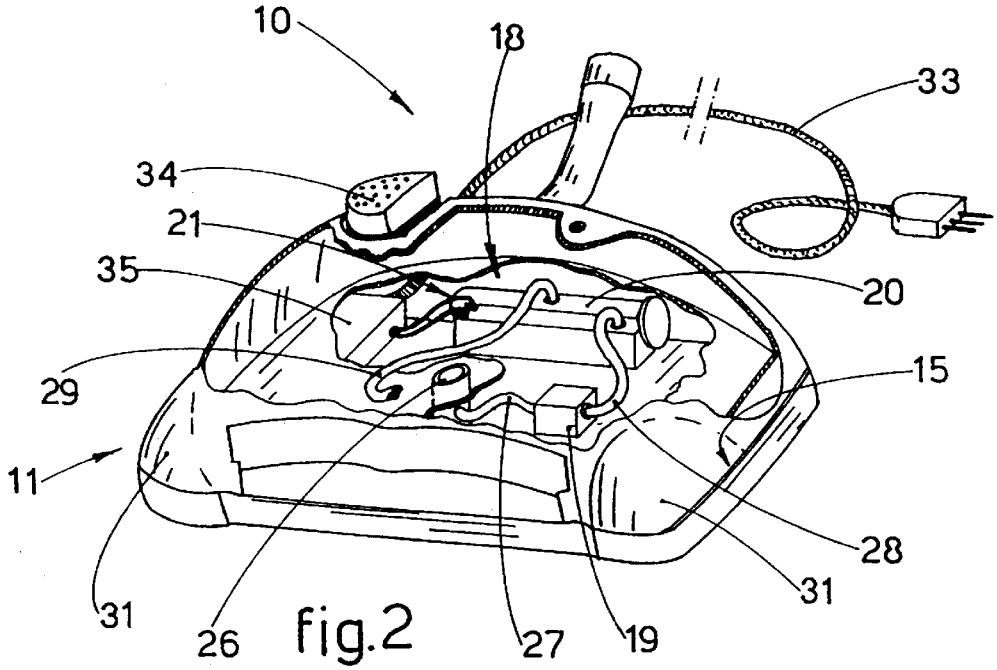
FIG. 2 shows a part section plane of the apparatus in FIG. 1 without the handle and the water tank.

As shown in FIG. 2, the containing seating 11 contains the steam generation unit 18 consisting, essentially, of a supply pump 19 and a small instant generator 20 suitable to generate instant steam under pressure by means of rapid heating means 21.

According to a variant, the components of the steam generation unit 18 are associated in a single body which can be removed from the box-like structure 11 for maintenance or repairs, or even to allow the steam generation unit 18 to be associated with other domestic appliances such as irons, humidifiers, spray-type cleaning devices, steam brushes, etc.

According to the invention, the supply pump 19 takes the water, which is to be delivered to the instant generator 20, from a tank 22 containing water at room temperature and equipped at the upper part with an aperture 23 for filling purposes.

The tank 22 is autonomous and can be removed from the containing structure 11 to facilitate filling, which can be carried out directly from the taps of the water supply.

It is thus possible to discharge any remaining water contained in the tank 22 if the cleaning apparatus 10 is unused for a long period of time.

On the bottom of the tank 22 there are feeder means 24 which connect the inner volume of the tank 22 with the supply pump 19.

In this case the feeder means 24 consist of a nozzle 25 suitable to be inserted in a water-tight manner inside an aperture 26 associated with the intake pipe 27 of the supply pump 19.

The steam generation unit 18 functions as follows:

The water contained in the tank 22 is taken in through the intake pipe 27 by the supply pump 19 and sent by means of a delivery pipe 28 to the instant generator 20 where it is transformed instantaneously into steam under pressure by means of the rapid heating means 21, for example an electrical resistor.

According to a variant, at the outlet of the instant generator 20 there are pressure switch means which are functionally connected with the rapid heating means 21.

Figure 4:
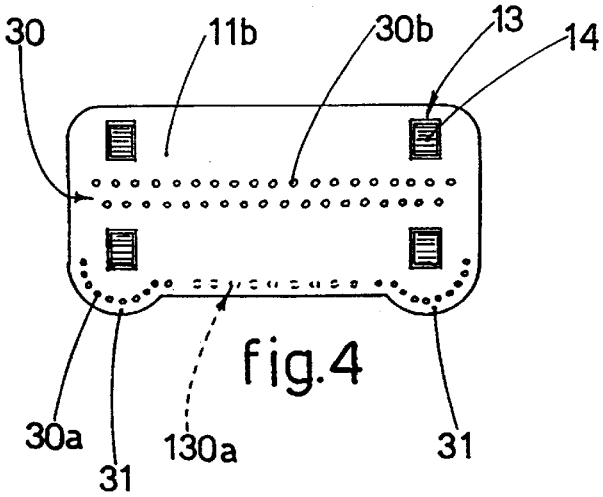
FIG. 4 shows a view from below of the cleaning apparatus shown in FIG. 1.

The steam is distributed by means of a pipe 29 to the plurality of delivery holes or slits 30 located on the lower face 11*b* of the containing structure 11 (FIG. 4).

In this case, the delivery holes 30 define a forward delivery zone cooperating with a pair of lateral shapings 31 including holes 30*a* used to clean small or inaccessible areas, for example the corners and edges of floors, and a central delivery zone comprising, in this case, two rows of holes 30*b* which run along the whole length of the lower face 11*b*, used to clean larger surfaces. There may also be holes 130*a* on the whole forward front of the containing structure 11.

By rotating the handle 32 connected to the delivery valve 36, the user can direct the steam to the holes 30*a*, the holes 30*b* or both sets of delivery holes 30*a* and 30*b* together.

Figure 6:
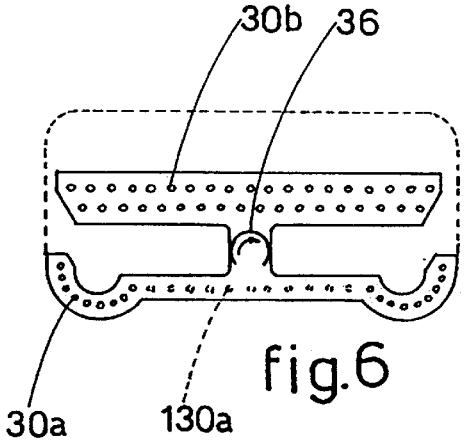
FIG. 6 shows a plan of the steam delivery function.
Figure 5:
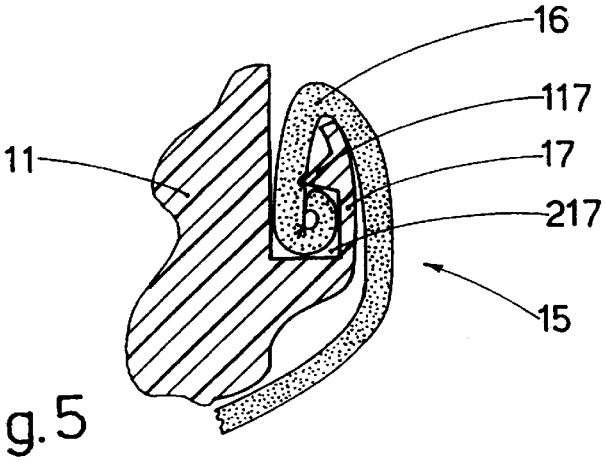
FIG. 5 is a part view of the enlarged section from A to A of FIG. 1.

In the case shown in FIG. 6, steam is delivered only through holes 30*a*; if the valve 36 is rotated through 180°, steam is delivered only through holes 30*b*; if the valve 36 is put in an intermediate position, steam is delivered from both holes 30*a* and 30*b*, the user simply has to adjust the valve 36 to have the preferred series of holes.

In this way, the user can choose whether to deliver the steam to a particular point or over a wider area in order to adapt the delivery of steam to the conformation of the surface which is to be cleaned, and also to vary the force of the steam on that surface so as to obtain the desired degree of cleaning.

The heating means 21 and the pump 19 are supplied with electricity by means of a cable 33 which can be connected to the mains power supply in the usual manner.

In the embodiment shown here, the cleaning apparatus 10 is switched on and off by changing the position of the handle 12 which in this case has articulated joints 212 on the lower part in order to facilitate the use and handling of the cleaning apparatus 10.

In this case, when the handle 12 is in the upright position only the rapid heating means 21 of the instant generator 20 are supplied with power in order to generate steam, whereas when the handle 12 is lowered, the pump 19 is also supplied with power in order to deliver the steam to the outside.

In the embodiment shown here, the handle 12 is maintained in the upright position by pedal means 34 which the user must press every time he/she wishes to lower the handle 12.

In the preferential embodiment shown here, the cleaning apparatus 10 includes a control unit 35 which can govern any desired devices (which are not shown here, for simplicity of description) used to automate the apparatus 10 such as, for example, level sensors, pressure switches, safety valves, etc.

According to a variant, the supply pump 19 is driven automatically by means of the control unit 35, and therefore the steam is also delivered automatically; the control unit 35 supplies the pump 19 continuously or temporally.

What is claimed is:

1. Steam cleaning apparatus for plane surfaces, comprising a containing structure having a substantially flat lower face suitable to cooperate with the plane surface to be cleaned and an upper face, the lower face of the containing structure including steam delivery holes, the delivery holes defining on the lower face of the containing structure at least two distinct delivery zones, respectively forward and central;

a tank for containing liquid at room temperature, the tank being removably mounted on the containing structure so that the tank can be temporally removed from the containing structure so that refilling operations can be carried out;

a handle attached to the containing structure;

an instantaneous steam generator having a rapid heater for generating steam;

a pump for pumping liquid from the tank to the instantaneous steam generator;

a conduit provided between the instantaneous steam generator and each of said at least two distinct deliver zones; and a valve for selecting at least one of the at least two delivery zones for delivering steam from the instantaneous steam generator.

2. Cleaning apparatus as in claim 1, characterised in that the valve is adjustable to select among a first condition wherein steam is supplied only to the forward zone, a second condition wherein steam is supplied only to the central zone, and a third condition wherein steam is supplied to both the forward and central zones.

3. Cleaning apparatus as in claim 2, characterised in that the forward zone includes delivery holes cooperating with lateral shapings arranged on the front part of the containing structure.

4. Cleaning apparatus as in claim 2, characterised in that the central zone includes delivery holes arranged on at least two rows covering substantially the width of the face.

5. Cleaning apparatus as in claim 1, characterised in that the containing structure, in correspondence with at least part of its perimeter, includes rapid gripping means to grip the ends of cleaning rags or cloths.

6. Cleaning apparatus as in claim 5, characterised in that the rapid gripping means comprises elastic fins including at least a tooth facing towards the containing structure and defining a seating to contain and grip a cleaning rag, or cloth.

7. Cleaning apparatus as in claim 1, characterised in that the instantaneous steam generator is made in a single piece and can be removed from the containing structure.

8. Cleaning apparatus as in claim 1, characterised in that the tank includes feeder means to be rapidly connected with the pump.

9. Cleaning apparatus as in claim 1, characterised in that the handle is associated with the containing structure by means of articulated joints.

10. Cleaning apparatus as in claim 9, characterised in that the handle includes a first inactive position, a second position wherein the rapid heating means are switched on, and a third position wherein the pump is activated.

11. Cleaning apparatus as in claim 1, characterised in that at the outlet of the instantaneous steam generator there is a pressure switch functionally connected to the rapid heater.

* * * * *